US006074172A

United States Patent [19]

Huang

[11] Patent Number: 6,074,172

[45] Date of Patent: Jun. 13, 2000

[54] CONTROLLER FOR COMPRESSOR

[75] Inventor: Bin-Juine Huang, Taipei, Taiwan

[73] Assignee: National Science Council, Taipei, Taiwan

[21] Appl. No.: 09/041,078

[22] Filed: Mar. 11, 1998

[30] Foreign Application Priority Data

Sep. 26, 1997 [TW] Taiwan ..... 86114103

[51] Int. Cl.[7] ..... F04B 49/12

[52] U.S. Cl. ..... 417/214; 417/212; 318/127

[58] Field of Search ..... 417/415, 212, 417/45, 326, 63, 214; 62/6, 228.1; 318/119, 127, 129

[56] References Cited

U.S. PATENT DOCUMENTS

| | | | |
|---|---|---|---|
| 3,659,968 | 5/1972 | Thomas, Jr. et al. | 417/417 |
| 4,353,220 | 10/1982 | Curwen et al. | 62/228.1 |
| 4,613,285 | 9/1986 | Sato et al. | 417/214 |
| 4,772,828 | 9/1988 | Heymans et al. | 318/128 |
| 5,535,593 | 7/1996 | Wu et al. | 62/6 |
| 5,836,165 | 11/1998 | Champion et al. | 62/6 |
| 5,947,693 | 9/1999 | Yang | 417/45 |

*Primary Examiner*—Henry C. Yuen
*Assistant Examiner*—Arnold Castro
*Attorney, Agent, or Firm*—Skjerven, Morrill, MacPherson, Franklin & Friel LLP

[57] ABSTRACT

A controller is provided to control and fix the stroke and frequency of the piston movement of the compressor under various operating conditions. The controller includes a signal generator for providing a first signal, a detector generating a second signal after detecting that the piston has a displacement, and a signal processing unit electrically connected to the signal generator and the detector for outputting a control signal to the compressor after receiving the first signal and the second signal to control a movement of the piston.

13 Claims, 2 Drawing Sheets

CONTROLLER FOR COMPRESSOR

FIELD OF THE INVENTION

The present invention is related to a controller adapted to be used in a compressor, and especially to a controller for controlling the stroke and the frequency of the piston movement of the compressor.

BACKGROUND OF THE INVENTION

A conventional reciprocating compressor utilizes a crankshaft mechanism to convert the rotational motion of the motor into the oscillating motion to drive a piston of the compressor and a frequency inverter is used to regulate the performance of the piston according to the load variation. However, the conventional compressor can be replaced by a compressor utilizing a linear motor to drive a piston of the compressor. Although this kind of compressor has lower noise and less vibration and wear than the conventional reciprocating compressor, the stroke of the piston is easily influenced by the exhaust pressure of the compressor without the crank and shaft to fix the movement of the piston. It brings about a low performance of this kind of the compressor. Therefore, the present invention provides a controller to regulate the piston stroke and to control the frequency of the movement of the piston under various operating conditions.

SUMMARY OF THE INVENTION

An object of the present invention is to provide a controller adapted to be used in a linear compressor to regulate the piston stroke and to control the frequency of the movement of the piston under various operating conditions.

According to the present invention, the controller includes a signal generator for providing a first signal, a detector generating a second signal after detecting that the piston of the compressor has a displacement, and a signal processing unit electrically connected to the signal generator and the detector for outputting a control signal to the compressor after receiving the first signal and the second signal to control a movement of the piston.

In accordance with one aspect of the present invention, the signal generator includes a stroke setting device electrically connected to the signal processing unit for outputting the first signal to the signal processing unit to set a specific stroke of the piston.

In accordance with another aspect of the present invention, the detector includes a displacement sensor disposed on the piston for detecting the displacement of the piston and outputting a third signal, and a rectifier electrically connected to the displacement sensor and the signal processing unit for converting the third signal to the second signal outputted to the signal processing unit.

In accordance with another aspect of the present invention, the signal processing unit includes a feedback controller electrically connected to the stroke setting device and the detector for outputting a fourth signal after comparing the second signal with the first signal, a direct current-to-alternating current (DC/AC) converter electrically connected to the feedback controller for converting the fourth signal to a fifth signal, and a power amplifier electrically connected to the DC/AC converter and the compressor for converting the fifth signal to the control signal to control the motor driving the movement of the piston.

In accordance with another aspect of the present invention, the feedback controller is a proportional plus integral plus derivative controller (PID).

In accordance with another aspect of the present invention, the feedback controller is a pseudo-differential feedback controller.

In accordance with another aspect of the present invention, the DC/AC converter includes a waveform generator for providing a sixth signal, and a multiplier electrically connected to the feedback controller, the power amplifier, and the waveform generator for outputting the fifth signal after multiplying the fifth signal by the sixth signal.

In accordance with another aspect of the present invention, the signal generator further includes a frequency setting device electrically connected to the DC/AC converter for outputting a frequency signal.

In accordance with another aspect of the present invention, the frequency setting device is a waveform generator for outputting the frequency signal to control a frequency of the movement of the piston after adjusting an internal resistor disposed in the frequency setting device.

The present invention may best be understood through the following description with reference to the accompanying drawings, in which:

DETAILED DESCRIPTION OF THE PREFERRED EMBODIMENT

Figure 1:
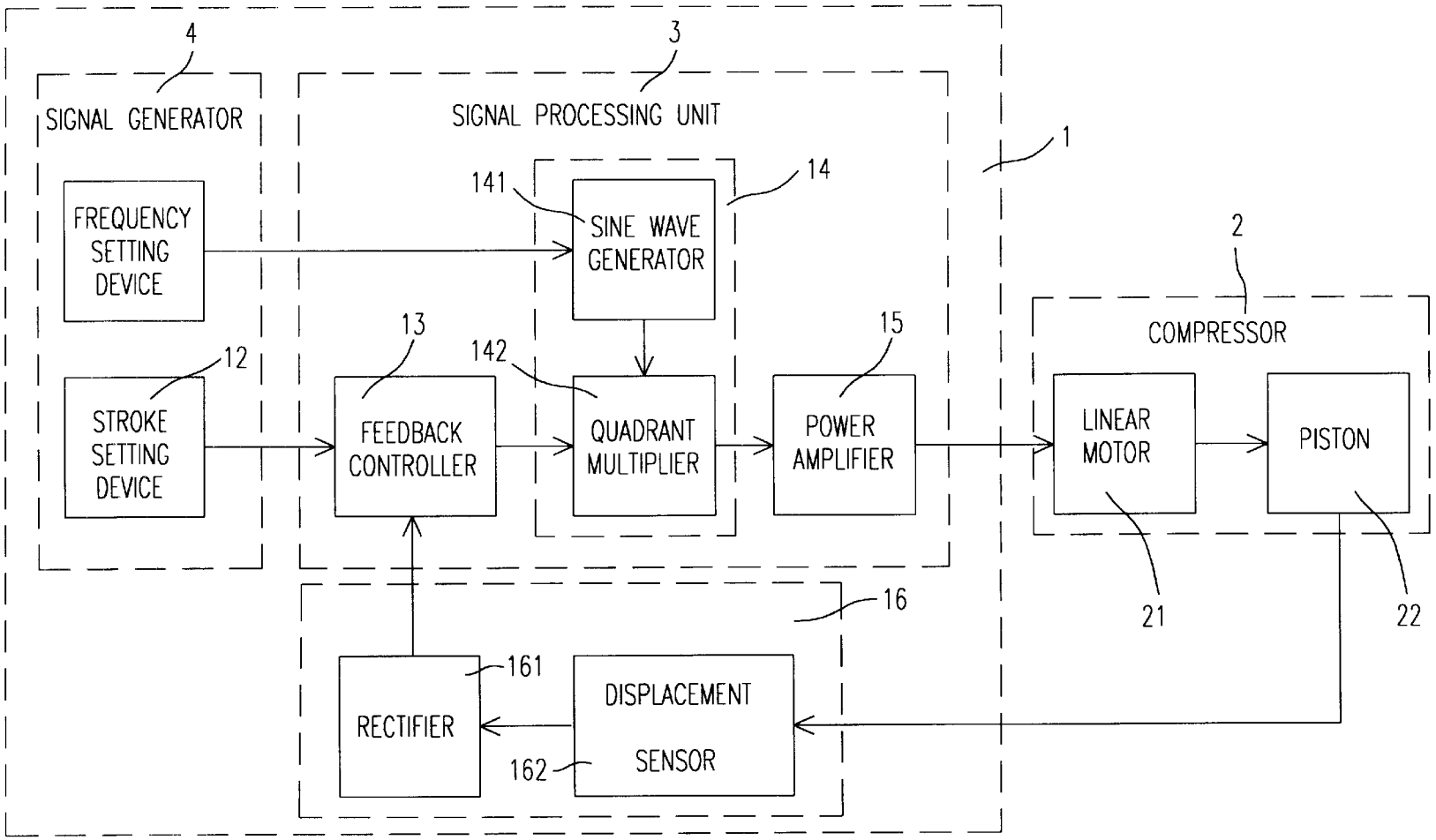
FIG. 1 is a block diagram showing a preferred embodiment of a controller connected to the compressor according to the present invention.

Please refer to FIG. 1 showing a preferred embodiment of a controller connected to the compressor according to the present invention. The controller 1 includes a signal generator 4, a detector 16 including a displacement sensor 162 and a rectifier 161, and a signal processing unit 3. The signal processing unit 3 further includes a feedback controller 13, a DC/AC converter 14 including a sine wave generator 141 and a quadrant multiplier 142, and a power amplifier 15. The feedback controller 13 can be a pseudo-differential feedback controller or a proportional plus integral plus derivative controller (PID) to stably and speedily adjust the piston stroke. The signal from the controller 1 of the present invention is applied to the compressor 2 for controlling a movement of the piston 22 driven by a linear motor 21.

As shown in FIG. 1, the displacement sensor 162 is disposed on the piston to detect the displacement of the piston during a stroke and generates an alternating current output signal inputted to the rectifier 161 (a full-wave rectifier) electrically connected to the displacement sensor 162. The alternating current output signal is converted to a direct current signal, representative of the piston stroke, inputted to the feedback controller 13 through the rectifier 161. The signal generator 4 includes a stroke setting device 12 outputting a specific stroke signal to the feedback controller 13. The feedback controller 13 generates an output signal transmitted to the quadrant multiplier 142 after comparing the direct current signal outputted from the rectifier 161 with the specific stroke signal. The output signal is multiplied by a sine wave signal generated from the sine wave generator 141 through the quadrant multiplier 142 and is converted to an alternating current control signal. The alternating current control signal is amplified to a control signal by the power amplifier 15 for controlling and fixing the stroke of the piston driven by the linear motor 21. The amplitude of the alternating current control signal varies along with the output signal generated from the feedback controller 13 so that the piston stroke can be changed. In addition, the signal generator 4 further includes a frequency setting device electrically connected to the DC/AC converter 14 for outputting a frequency signal to control a frequency of the movement of the piston. By adjusting an internal resistor disposed in the frequency setting device, the frequency of the sine wave can be changed to achieve the purpose of changing the frequency of the compressor. The frequency setting device can be a sine wave generator. The frequency signal from device 41 is converted to an alternating current signal with an amplitude controlled by the quadrant multiplier 142. The alternating current signal is amplified by the power amplifier 15 to control the frequency and the movement of the piston.

Figure 2:
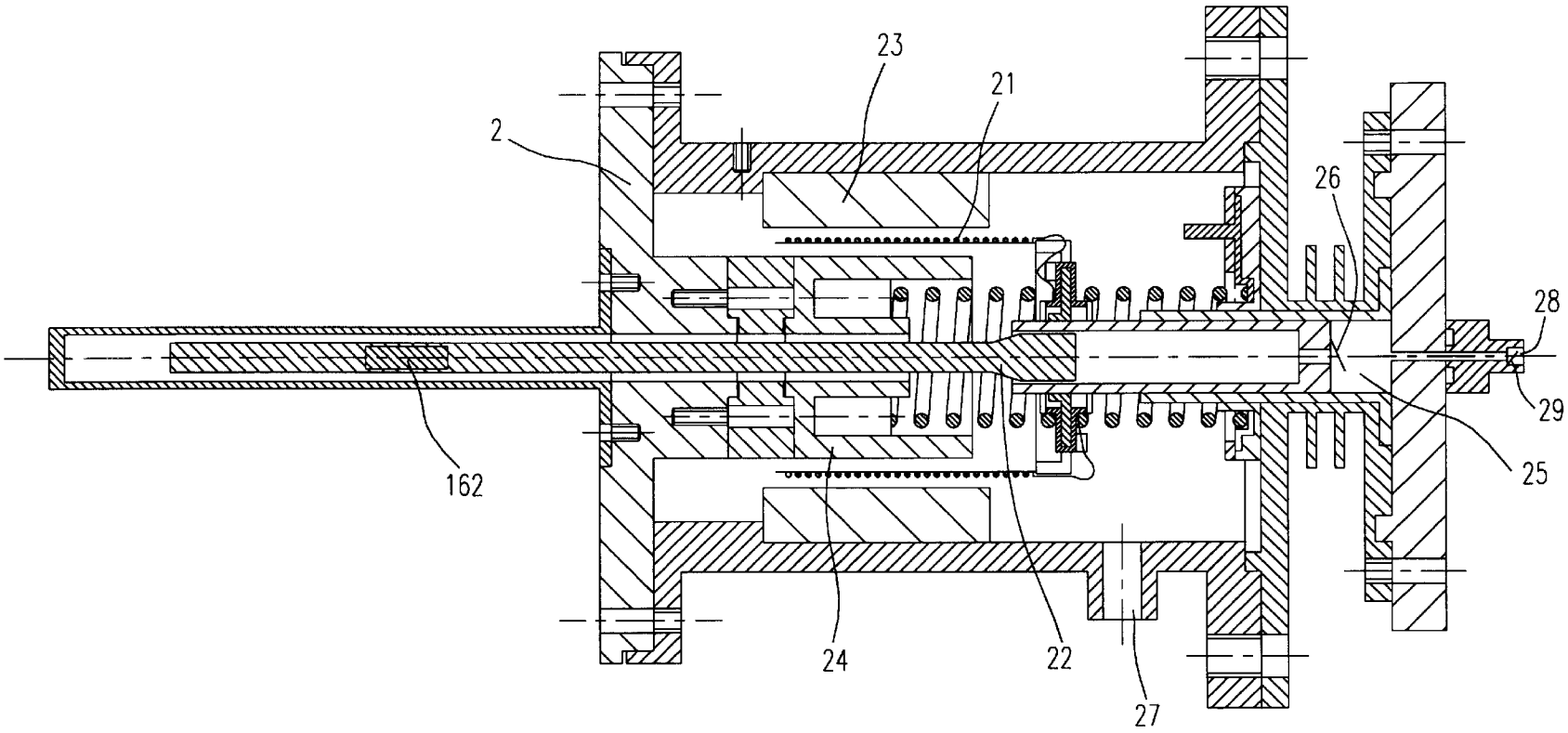
FIG. 2 is a schematic diagram showing a structure of a linear compressor of the preferred embodiment of the present invention.

FIG. 2 shows a structure of a linear compressor of the preferred embodiment of the present invention. The linear compressor 2 includes a linear motor 21, a piston 22, two magnets 23, 24, two non-return flaps 26, 29, an intake port 27, and a vent 28. As shown in FIG. 2, the linear motor performs an axially reciprocating operation after being induced with these two magnets 23, 24 according to the control signal. The piston 22 can be driven by the linear motor 21 to compress gas introduced from the intake port 27. The gas compressed by the piston 22 passes through the non-return flap 26 into chamber 25 and will be prohibited to return by the non-return flap 26. Finally, the gas passes through the non-return flap 29 and is discharged from the vent 28.

In conclusion, the controller according to the present invention is provided to effectively control and fix the stroke of the piston and to control the frequency of the movement of the piston at the same time under various operating conditions.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An apparatus comprising:

a compressor having a piston driven by a motor:

a signal generator providing a first signal to set a specific stroke of said piston;

a signal processing unit receiving said first signal from said signal generator;

A feedback loop comprising said piston, a detector generating a second signal after detecting a displacement of said piston, said detector providing said second signal to said signal processing unit;

wherein said signal processing unit outputs a third signal after comparing said first signal and said second signal, said third signal being converted to a control signal for controlling and fixing the stroke of said piston, and wherein said stroke of said piston is controlled solely by said signal processing unit.

2. A controller adapted to be used in a compressor having a piston and a motor comprising:

a signal generator for providing a first signal;

a detector generating a second signal after detecting a stroke of said piston; and a signal processing unit electrically connected to said signal generator and said detector for outputting a control signal to said compressor after receiving and comparing said first signal and said second signal to control said stroke of said piston wherein said signal generator includes a stroke setting device electrically connected to said signal processing unit for outputting said first signal to said signal processing unit to set a specific stroke of said piston.

3. A controller according to claim 2 wherein said detector comprises:

a displacement sensor disposed on said piston for detecting said stroke of said piston and outputting a third signal; and a rectifier electrically connected to said displacement sensor and said signal processing unit for converting said third signal to said second signal outputted to said signal processing unit.

4. A controller according to claim 3 wherein said signal processing unit comprises:

a feedback controller electrically connected to said stroke setting device and said detector for outputting a fourth signal after comparing said second signal with said first signal;

a DC/AC converter electrically connected to said feedback controller for converting said fourth signal to a fifth signal; and a power amplifier electrically connected to said DC/AC converter and said compressor for converting said fifth signal to said control signal to control said motor driving said stroke of said piston.

5. A controller according to claim 4 wherein said feedback controller is a proportional plus integral plus derivative controller (PID).

6. A controller according to claim 4 wherein said feedback controller is a pseudo-differential feedback controller.

7. A controller according to claim 4 wherein said DC/AC converter includes:

a waveform generator for providing a sixth signal; and a multiplier electrically connected to said feedback controller, said power amplifier, and said waveform generator for outputting said fifth signal after multiplying said fifth signal by said sixth signal.

8. A controller according to claim 4 wherein said signal generator further includes a frequency setting device electrically connected to said DC/AC converter for outputting a frequency signal.

9. A controller according to claim 8 wherein said frequency setting device is a signal generator for outputting said frequency signal to control a frequency of said movement of said piston after adjusting an internal resistor disposed in said frequency setting device.

10. A controller adapted to be used in a compressor having a piston and a motor comprising:

a signal generator for providing a frequency signal; and a signal processing unit electrically connected to said signal generator for outputting a control signal to said compressor after receiving said frequency signal to control a frequency of a movement of said piston wherein said signal generator is a waveform generator outputting said frequency signal for controlling said frequency of said movement of said piston after adjusting an internal resistor disposed in said waveform generator.

11. A controller according to claim 10 wherein said signal processing unit includes:

a multiplier electrically connected to said waveform generator for outputting a first signal after receiving said frequency signal; and a power amplifier electrically connected to and said compressor for converting said first signal to said control signal to control said frequency of said movement of said piston.

12. A controller adapted to be used in a compressor having a piston and a motor comprising:

a signal generator for providing a frequency signal;

a signal processing unit electrically connected to said signal generator for outputting a control signal to said compressor after receiving said frequency signal to control a frequency of a movement of said piston;

a detector generating a second signal after detecting a stroke of said piston;

a stroke setting device electrically connected to said signal processing unit for outputting a third signal to said signal processing unit to set a specific stroke of said piston; and a feedback controller electrically connected to said stroke setting device and said detector for outputting a fourth signal after comparing said third signal with said second signal.

13. A controller according to claim 12 wherein said detector includes:

a displacement sensor disposed on said piston for detecting said displacement of said piston and outputting a fifth signal; and a rectifier electrically connected to said displacement sensor and said signal processing unit for converting said fifth signal to said second signal outputted to said signal processing unit.

* * * * *